US008038326B2

(12) United States Patent
Hsu

(10) Patent No.: US 8,038,326 B2
(45) Date of Patent: Oct. 18, 2011

(54) ORNAMENTAL LAMP

(76) Inventor: Yuan-Shun Hsu, Hsinchu County (TW)

( * ) Notice: Subject to any disclaimer, the term of this patent is extended or adjusted under 35 U.S.C. 154(b) by 15 days.

(21) Appl. No.: 12/687,783

(22) Filed: Jan. 14, 2010

(65) Prior Publication Data

US 2011/0169397 A1 Jul. 14, 2011

(51) Int. Cl.
*F21V 3/00* (2006.01)

(52) U.S. Cl. ..... 362/311.02; 362/249.06; 362/311.13; 362/311.14; 362/647

(58) Field of Classification Search ..... 362/227, 362/234, 249.02, 249.06, 249.14–249.16, 362/647, 311.02, 311.13, 311.14
See application file for complete search history.

(56) References Cited

U.S. PATENT DOCUMENTS

2009/0021951 A1* 1/2009 Yu ..... 362/375
2009/0073685 A1* 3/2009 Pan ..... 362/227

FOREIGN PATENT DOCUMENTS

TW M358251 6/2009

* cited by examiner

*Primary Examiner* — Stephen F Husar
*Assistant Examiner* — Meghan Dunwiddie
(74) *Attorney, Agent, or Firm* — Muncy, Geissler, Olds & Lowe, PLLC

(57) ABSTRACT

An ornamental lamp comprises a barrel holder, an LED lamp set and a lamp shade. The barrel holder includes an opening, two electric connecting ports communicating with the opening and two elastic holding struts held in the opening. The elastic holding struts and the inner edge of the opening form a housing space therebetween. The two elastic holding struts are divided by a notch in the middle. The LED lamp set has two conductive pins running through the electric connecting ports to receive electric power. The LED lamp set has a lower edge butting the elastic holding struts. The lamp shade is wedged in the housing space and pushes the elastic holding struts inwards during wedging to bend slightly towards the notch. The bent portion of the elastic holding struts generates an elastic returning force to clamp the lamp shade in a compact manner.

11 Claims, 4 Drawing Sheets

ORNAMENTAL LAMP

FIELD OF THE INVENTION

The present invention relates to an ornamental lamp and particularly to an ornamental lamp that includes an LED as a light source and a lamp holder to facilitate assembly.

BACKGROUND OF THE INVENTION

Special lighting colors can provide buildings or ornaments more appealing look. To meet this purpose, ornamental lamps capable of being strung together in a great number have been developed at lower cost and widely adopted. To further meet varying requirements of special occasions such as festivals or ceremonies, different types of ornamental lamps also have been designed. Due to many factors, such as producers constantly try to reduce production cost, the lamps are connected in series in a great number that causes the wires to sustain too much current, lamp quality varies widely, and bad holding and storing conditions. All these significantly reduce the life span of the ornamental lamps.

To remedy the aforesaid problems, R.O.C. patent No. M358251 entitled "Improved lamp head for LED Christmas lamp strings" discloses a Christmas lamp comprising an LED (1), a lamp stalk (2) and a lamp casing (3). The lamp stalk (2) has a holding trough (21) at an upper side and a holder (22) at a lower side. The LED (1) is held in the holding trough (21) and has two conductive pins (1111, 1121) run through the holding trough (21). Then the LED (1) and the lamp stalk (2) are wedged in the lamp casing (3) together. While it claims to provide the advantage of reducing labor and production time, the lamp stalk and lamp casing have to be fabricated separately and result in a higher material cost. Moreover, the LED is directly mounted onto the lamp stalk and packaged in a conical manner without encasing a light penetrating lamp shade outside the LED. As the main purpose of the ornamental lamp is to provide special profiles and diversified colors, to meet this purpose more diversified LED package profiles have to be provided. This requires extra production facility and higher production cost. In the event that increasing LED color variation is needed, even more costs are incurred.

Thus there is still room for improvement on the ornamental lamp, especially in terms of assembly convenience, material cost and customization capability.

SUMMARY OF THE INVENTION

In view of the aforesaid unfulfilled requirements occurred to the conventional ornamental lamp, the present invention aims to provide an improved ornamental lamp that includes simplified elements and can be fabricated with less material cost, and also offers diversified profiles and colors to meet customers' varying requirements.

The present invention provides an ornamental lamp which comprises a barrel holder, an LED lamp set and a lamp shade. The barrel holder has an opening, two electric connecting ports communicating with the opening and two elastic holding struts held in the opening. The elastic holding struts and the inner edge of the opening form a housing space between them. The two elastic holding struts are divided by a notch in the middle. The LED lamp set has two conductive pins running through the electric connecting ports to receive electric power. The LED lamp set has a lower edge butting the elastic holding struts. The lamp shade is wedged in the housing space. The lamp shade pushes the elastic holding struts inwards during wedging to bend slightly towards the notch.

The bent portion of the elastic holding struts generates an elastic returning force to clamp the lamp shade in a compact manner. The structure thus formed does not change the package structure of the LED lamp set. By means of displacing the lamp shade of different profiles and colors, the ornamental lamp can be provided with different colors and appearances. It also utilizes fewer elements to reduce material cost.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
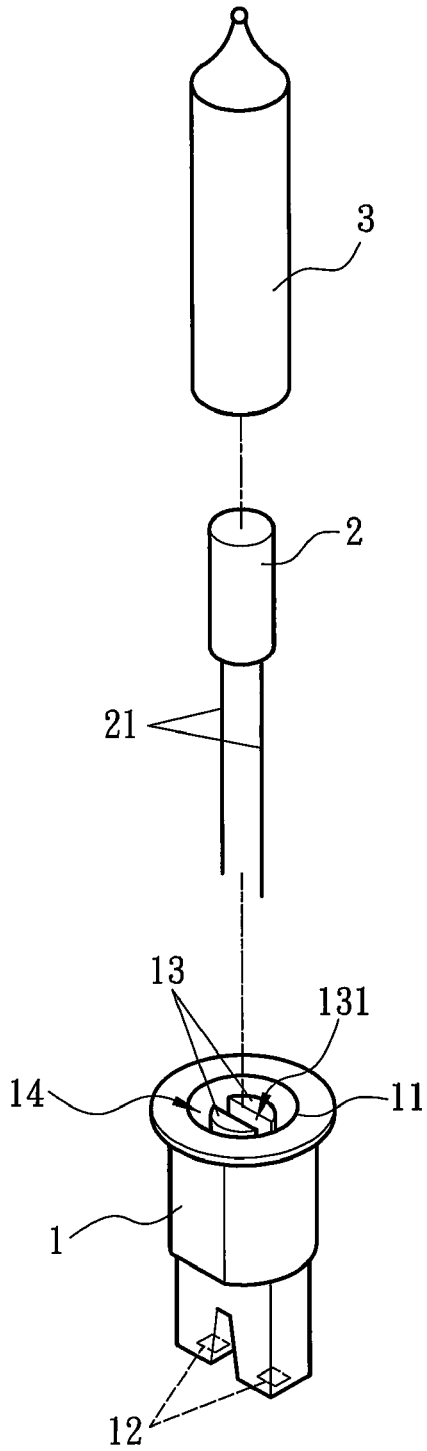
FIG. 1 is an exploded view of a preferred embodiment of the ornamental lamp of the present invention.
Figure 2:
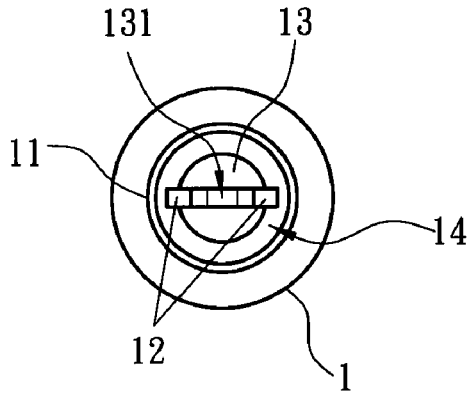
FIG. 2 is a top view of the barrel holder.
Figure 3:
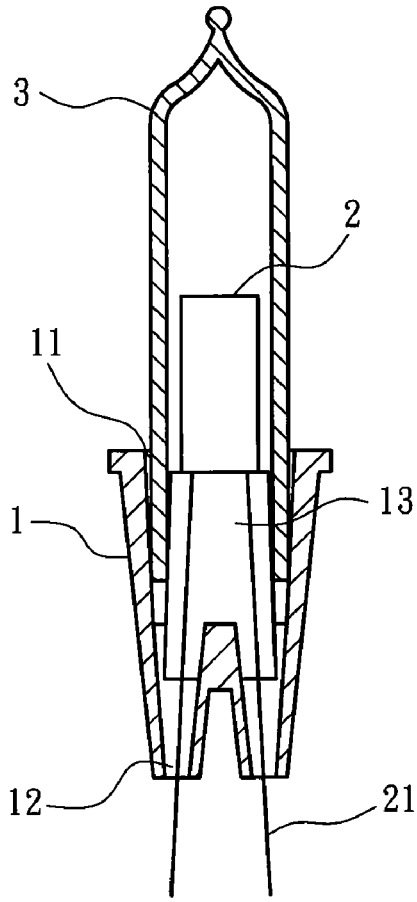
FIG. 3 is a sectional view of the preferred embodiment of the ornamental lamp of the present invention.
Figure 4:
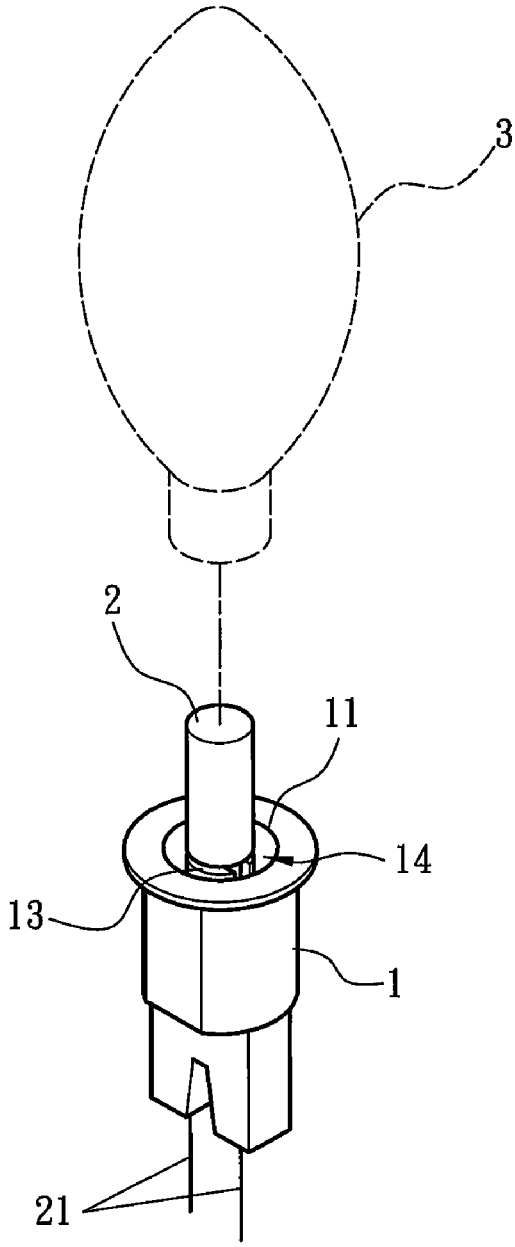
FIG. 4 is a schematic view of another embodiment of the ornamental lamp of the present invention.

Please refer to FIGS. 1, 2 and 3 for a first embodiment of the ornamental lamp of the present invention. It comprises a barrel holder 1, an LED lamp set 2 and a lamp shade 3. The barrel holder 1 has an opening 11, two electric connecting ports 12 and two elastic holding struts 13 held in the opening 11. The elastic holding struts 13 and the inner edge of the opening 11 form a housing space 14. The two elastic struts 13 are divided by a notch 131 in the middle. The elastic holding struts 13 may be formed at a height lower than that of the opening 11 (as shown in FIG. 1), or the elastic holding struts 13 also can be higher than the opening 11. The opening 11 has a distal end communicating with the electric connecting ports 12. The LED lamp set 2 has two conductive pins 21 running through the electric connecting ports 12 to receive electric power. The LED lamp set 2 also has a lower edge butting the elastic holding struts 13. Each of the elastic holding struts 13 in this embodiment is semicircular, but also may be triangular, quadrangular or other geometric pillared shapes. The lamp shade 3 is inserted into the housing space 14. In the embodiment shown in FIGS. 1, 2 and 3, the lamp shape 3 is cylindrical, but may also be elliptic as shown in FIG. 4. Further, the lamp shape 3 also can be circular, pillared polygons, conical, conical polygons and the like that are not shown in the drawings, but shall be included in the scope of the present invention.

Figure 5A:
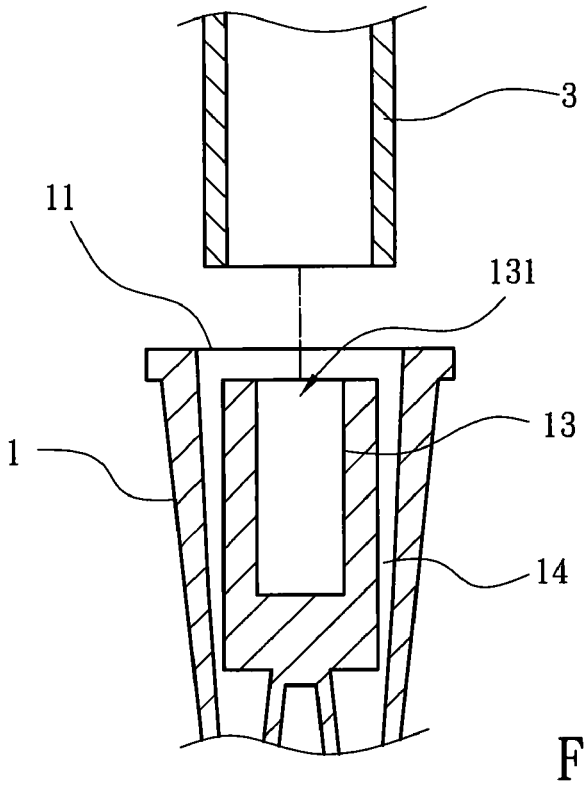
FIG. 5A is a schematic view of the present invention showing assembly condition-1 of the lamp shade.
Figure 5B:
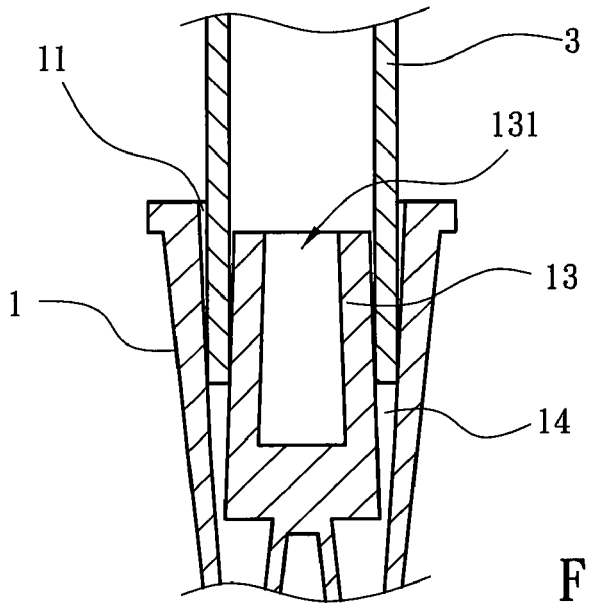
FIG. 5B is a schematic view of the present invention showing assembly condition-2 of the lamp shade.

Referring to FIGS. 5A and 5B, with FIG. 5A showing the condition before the lamp shade 3 inserting into the barrel holder 1, the housing space 14 located between the lamp shade 3 and the inner edge of the barrel holder 1 also can be clearly seen. The LED lamp set 2 is omitted in FIGS. 5A and 5B in order to facilitate showing the relative operations of the lamp shade 3, the housing space 14 and the elastic holding struts 13 while the lamp shade 3 inserting into the housing space 14. Referring to FIG. 5B, when the lamp shade 3 is wedged in the housing space 14, it pushes the elastic holding struts 13 inwards to slightly bend towards the notch 131, and an elastic returning force is generated on the bent portion of the elastic holding struts 13 to form a compact force clamping the lamp shade 3 towards the inner edge of the barrel holder 1, thus the lamp shade 3 is held in the housing space 14. By means of the foregoing structure, there is no need to change the package structure of the LED lamp set 2. By directly displacing the lamp shade 3 of different profiles and colors, the ornamental lamp can provide varying colors and appearances as desired. The ornamental lamp thus formed uses fewer elements and can reduce material cost. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An ornamental lamp, comprising:

a barrel holder which includes an opening, two electric connecting ports communicating with the opening and two elastic holding struts located in the opening, the elastic holding struts and an inner edge of the opening forming a housing space therebetween, the two elastic holding struts being divided by a notch in the middle thereof;

an LED lamp set which includes two conductive pins running through the two electric connecting ports to receive electric power and a lower edge butting the elastic holding struts; and a lamp shade which is wedged in the housing space and pushes the elastic holding struts bending towards the notch such that an elastic returning force is generated on the bent portion of the elastic holding struts to form a compact force clamping the lamp shade towards the inner edge of the barrel holder.

2. The ornamental lamp of claim 1, wherein the elastic holding struts are formed in a circular circumference.

3. The ornamental lamp of claim 1, wherein the lamp shade is formed in a cylindrical shape.

4. The ornamental lamp of claim 1, wherein the lamp shade is formed in an elliptic shape.

5. The ornamental lamp of claim 1, wherein the lamp shade is formed in a pillared polygon.

6. The ornamental lamp of claim 1, wherein the lamp shade is formed in a conical shape.

7. The ornamental lamp of claim 1, wherein the lamp shade is formed in a conical polygon.

8. The ornamental lamp of claim 1, wherein the elastic holding struts are formed at a height higher than that of the opening.

9. The ornamental lamp of claim 1, wherein the elastic holding struts are formed at a height lower than that of the opening.

10. The ornamental lamp of claim 1, wherein the elastic holding struts and the inner edge of the opening are separated.

11. The ornamental lamp of claim 1, wherein the elastic holding struts prevent downward movement of the LED lamp set.

* * * * *